US006806895B2

(12) United States Patent
Jeong

(10) Patent No.: US 6,806,895 B2
(45) Date of Patent: Oct. 19, 2004

(54) METHOD AND APPARATUS FOR AN ELECTROPHOTOGRAPHIC PRINTER WHERE VOLTAGE MAGNITUDE APPLIED TO CHARGE ROLLER AND INTENSITY OF ILLUMINATION UNIT VARY DEPENDING ON TYPE OF PRINT JOB SUBMITTED

(75) Inventor: Su-jong Jeong, Gumi-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 22 days.

(21) Appl. No.: 09/960,305

(22) Filed: Sep. 24, 2001

(65) Prior Publication Data

US 2002/0101496 A1 Aug. 1, 2002

(30) Foreign Application Priority Data

Jan. 26, 2001 (KR) ..... 2001-3747

(51) Int. Cl.[7] ..... G03G 15/00; G03G 15/02; G03G 15/043

(52) U.S. Cl. ..... 347/140; 399/45; 399/50; 399/51; 399/82

(58) Field of Search ..... 399/50, 39, 45, 399/88, 82, 37, 51; 347/140

(56) References Cited

U.S. PATENT DOCUMENTS 5,666,589 A * 9/1997 Yoshinaga et al.
5,719,613 A * 2/1998 Fukui et al.
5,734,951 A * 3/1998 Maekawa et al. ..... 399/50
5,991,557 A * 11/1999 Kunishi et al. ..... 399/50
6,070,029 A * 5/2000 Nishiuwatoko et al.
6,088,548 A * 7/2000 Hashimoto et al. ..... 399/50
6,134,401 A * 10/2000 Yun et al. ..... 399/88
6,185,387 B1 * 2/2001 Ohzeki et al.
6,208,770 B1 * 3/2001 Gilman et al.
6,246,847 B1 * 6/2001 Jeong et al.
6,339,476 B2 * 1/2002 Kajiwara et al.
6,408,145 B1 * 6/2002 Ohki ..... 399/50
2002/0063887 A1 * 5/2002 White
2002/0067498 A1 * 6/2002 Chapman

FOREIGN PATENT DOCUMENTS

JP 8-76533 * 3/1996

* cited by examiner

*Primary Examiner*—Susan Lee
(74) *Attorney, Agent, or Firm*—Robert E. Bushnell, Esq.

(57) ABSTRACT

An electrophotographic printing method and apparatus in which a charge voltage is appropriately adjusted depending on the resolution selected for electrophotographic printing or the print mode are provided. The electrophotographic printing method and electrophotographic imaging apparatus provide for selecting a resolution for electrophotographic printing; charging an organic photoconductor (OPC) by applying to a charge roller an appropriate charge voltage depending on the selected resolution; forming an electrostatic latent image on the charged OPC by a laser scanning unit (LSU) and applying toner particles adhering to a developer roller to the electrostatic latent image to form a visible image; and transferring the visible image formed on the OPC to a sheet of print paper. By selecting the print resolution or print mode, the charge voltage can be adjusted depending on the print resolution or print mode, so that an image can be obtained with reduced image concentration variation.

31 Claims, 5 Drawing Sheets

METHOD AND APPARATUS FOR AN ELECTROPHOTOGRAPHIC PRINTER WHERE VOLTAGE MAGNITUDE APPLIED TO CHARGE ROLLER AND INTENSITY OF ILLUMINATION UNIT VARY DEPENDING ON TYPE OF PRINT JOB SUBMITTED

CLAIM OF PRIORITY

This application makes reference to, incorporates the same herein, and claims all benefits accruing under 35 U.S.C. §119 from my application A METHOD FOR PRINTING ELECTRIC PICTURE filed with the Korean Industrial Property Office on 26 Jan. 2001 and there duly assigned Serial No. 3747/2001.

BACKGROUND OF THE INVENTION

1. Field of the Invention

The present invention relates to an electrophotographic printing method and, more particularly, to an electrophotographic printing method in which a charge voltage is appropriately varied depending on the print resolution or print mode.

2. Description of the Related Art

A general electrophotographic imaging system, such as a copy machine, printer or facsimile, includes a controller for controlling formation of an image, a laser scanning unit (LSU), a high-voltage power supply (HVPS), a charge roller, a photoreceptor drum serving as an organic photoconductor (OPC), a developer roller, a transfer roller, and a blade.

Under the control of the controller, the HVPS supplies a charge voltage of −1.4 kilo Volts (kV) to the charge roller, a development voltage of −300 Volts (V) to the developer roller, and a transfer voltage of +2.0 kV to the transfer roller.

As the development voltage of −300 V is applied to the developer roller by the HVPS, toner particles which almost have a negative charge are attracted to the surface of the developer roller by frictional force acting between a toner supply roller and the developer roller. However, due to a large amount of stress between the toner supply roller and the developer roller and irregular toner particle size, toner particles having a positive charge can be applied to the surface of the developer roller. The charge roller is formed of a conductive roller having an appropriate resistance. As a voltage of −1.4 kV is applied to the charge roller, the surface of the OPC is charged to a negative potential of −800 V. Under the control of the controller, the LSU scans the surface of the OPC with a beam to form an electrostatic latent image on the OPC. Here, an image area in which the electrostatic latent image is formed has a potential of −50 V, and a non-image area has a potential of −800 V.

Meanwhile, as the electrostatic latent image area of the OPC passes the developer roller, toner particles adhering to the surface of the developer roller migrate to the electrostatic latent image area of the OPC by a potential difference, so that a visible image is formed on the surface of the OPC. The visible image formed on the surface of the OPC is transferred to and printed on a paper passing through a gap, which is also called a "nip", between the OPC and the transfer roller. The blade is used to mechanically remove the toner particles remaining on the surface of the OPC.

When a print command is input from a user, an image which is intended to be printed is input to an electrophotographic imaging apparatus through a personal computer (PC). The controller starts to operate (ON-state) to form a matrix of dots in accordance with the input image. A charge voltage of −1.4 kV is applied to the charge roller under the control of the controller to charge the OPC to a potential of −800 V.

As the LSU scans the matrix of dots formed on the surface of the OPC with a laser beam in response to a control signal from the controller, the potential of the exposed area is changed to have a potential of −50 V and the non-exposed remains at a potential of −800 V.

When toner particles are applied to the exposed area of the OPC to form a visible image, a sheet of paper is fed through the nip formed between the transfer roller and the OPC. As a high voltage of from 500 to 3,000 V is applied to the transfer roller, the toner image formed on the OPC is transferred to the paper. The toner particles remaining on the OPC which are not transferred to the paper are removed by the blade and transferred into a recycled toner container. As the paper passes a fusing unit, a permanent image is printed on the paper by hot pressing. If it is determined to continue printing, the process returns to the first step and the above-described steps are repeated. The potential variation of the OPC is proportional to a gray pattern level variation. Assuming that the same printing conditions are applied, the gray level variation is greater for the 1 by 1 dot size than for the 4 by 4 dot size. The same result can be obtained from comparison of the printing results at resolutions of 600 dots per inch (dpi.) and 1200 dpi. In other words, because the dot size is smaller at 1200 dpi. than at 600 dpi., the gray level variation is greater at 1200 dpi. Thus, there is a problem that a desired high quality print output typically cannot be obtained.

SUMMARY OF THE INVENTION

To solve the above-described problems, it is a first object, among other objects, of the present invention to provide an electrophotographic printing method in which a charge voltage is appropriately varied depending on the print resolution.

It is a second object, among other objects, of the present invention to provide an electrophotographic printing method in which a charge voltage is appropriately varied depending on print mode.

To achieve the first object of the present invention, there is provided an electrophotographic image printing method for an electrophotographic imaging apparatus, the electrophotographic imaging apparatus including: a charge roller; a developer roller; a laser scanning unit (LSU); a transfer roller; an organic photoconductor (OPC); a power supply unit for supplying power to the charge roller, the developer roller, the LSU, the transfer roller, and the OPC; and a controller for controlling the power supply unit, the charge roller, the developer roller, the LSU, the transfer roller, and the OPC, the method comprising the steps of: (a) selecting a resolution for electrophotographic printing; (b) charging the OPC by applying to the charge roller an appropriate charge voltage depending on the selected resolution for electrophotographic printing; (c) forming an electrostatic latent image on the charged OPC by the LSU and applying toner particles adhering to the developer roller to the electrostatic latent image to form a visible image; and (d) transferring the visible image formed on the OPC to a sheet of print paper.

It is preferable that, when the resolution selected for electrophotographic printing in step (a) has a lower level, the charge voltage of step (b) is set to be higher than when the resolution selected in step (a) has a higher level.

To achieve the second object of the present invention, there is provided an electrophotographic printing method for an electrophotographic imaging apparatus, the electrophotographic imaging apparatus including: a charge roller; a developer roller; a laser scanning unit (LSU); a transfer roller; an organic photoconductor (OPC); a power supply unit for supplying power to the charge roller, the developer roller, the LSU, the transfer roller, and the OPC; and a controller for controlling the power supply unit, the charge roller, the developer roller, the LSU, the transfer roller, and the OPC, the method comprising the steps of: (a) selecting a print mode for electrophotographic printing; (b) charging the OPC by applying to the charge roller an appropriate charge voltage depending on the selected print mode for electrophotographic printing; (c) forming an electrostatic latent image on the charged OPC by the LSU and applying toner particles adhering to the developer roller to the electrostatic latent image to form a visible image; and (d) transferring the visible image formed on the OPC to a sheet of print paper.

It is preferable that the print mode selected in step (a) includes a text mode and a graphics mode, and the charge voltage applied to the charge roller of step (b) is set to be higher in the text mode than in the graphics mode.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings, in which like reference numerals indicate the same or similar components, and wherein.

DETAILED DESCRIPTION OF THE INVENTION

Figure 1:
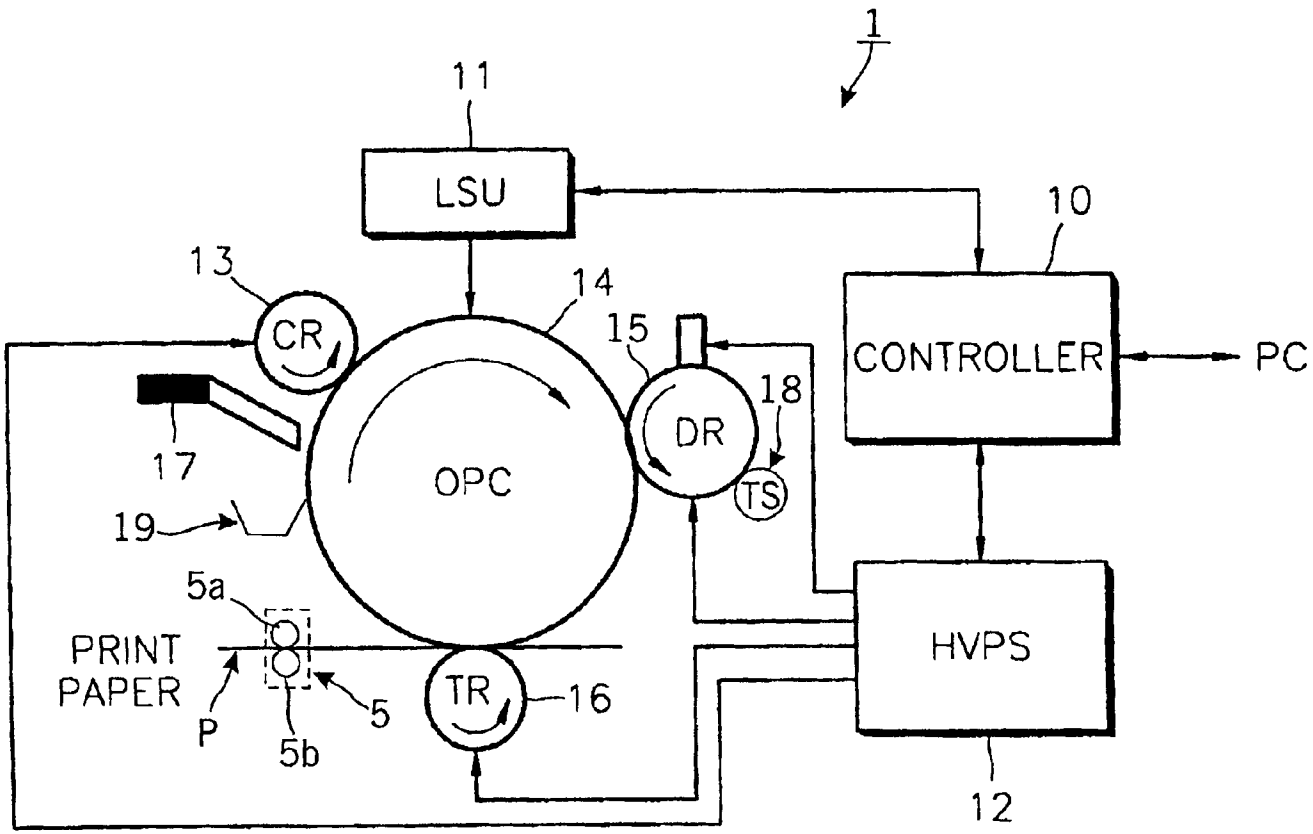
FIG. 1 is a block diagram illustrating a general electrophotographic imaging apparatus or system to which the present invention is applicable.

As shown in FIG. 1, a general electrophotographic imaging apparatus or system 1 to which the present invention is applicable, such as a copy machine, printer or facsimile, includes a controller 10, such as a microprocessor or central processing unit (CPU), for controlling formation of an image, a laser scanning unit (LSU) 11, a high-voltage power supply (HVPS) 12, a charge roller (CR) 13, a photoreceptor drum serving as an organic photoconductor (OPC) 14, a developer roller (DR) 15, a transfer roller (TR) 16, and a blade 17.

Under the control of the controller 10, the HVPS 12 supplies a charge voltage of −1.4 kV to the charge roller 13, a development voltage of −300 V to the developer roller 15, and a transfer voltage of +2.0 kV to the transfer roller 16.

As the development voltage of −300 V is applied to the developer roller 15 by the HVPS 12, toner particles which almost have a negative charge are attracted to the surface of the developer roller 15 by frictional force acting between a toner supply roller (TS) 18 and the developer roller 15. However, due to a large amount of stress between the toner supply roller 18 and the developer roller 15 and irregular toner particle size, toner particles having a positive charge can be applied to the surface of the developer roller 15. The charge roller 13 is formed of a conductive roller having an appropriate resistance. As a voltage of −1.4 kV is applied to the charge roller 13, the surface of the photoreceptor drum or OPC 14 is charged to a negative potential of −800 V. Under the control of the controller 10, the LSU 11 scans the surface of the OPC 14 with a beam to form an electrostatic latent image on the OPC 14. Here, an image area in which the electrostatic latent image is formed has a potential of −50 V, and a non-image area has a potential of −800 V.

Meanwhile, as the electrostatic latent image area of the OPC 14 passes the developer roller 15, toner particles adhering to the surface of the developer roller 15 migrate to the electrostatic latent image area of the OPC 14 by a potential difference, so that a visible image is formed on the surface of the OPC 14. The visible image formed on the surface of the OPC 14 is transferred to and printed on a paper P passing through a gap, which is also called a "nip", between the OPC 14 and the transfer roller 16. The blade 17 is used to mechanically remove the toner particles remaining on the surface of the OPC 14.

Figure 2:
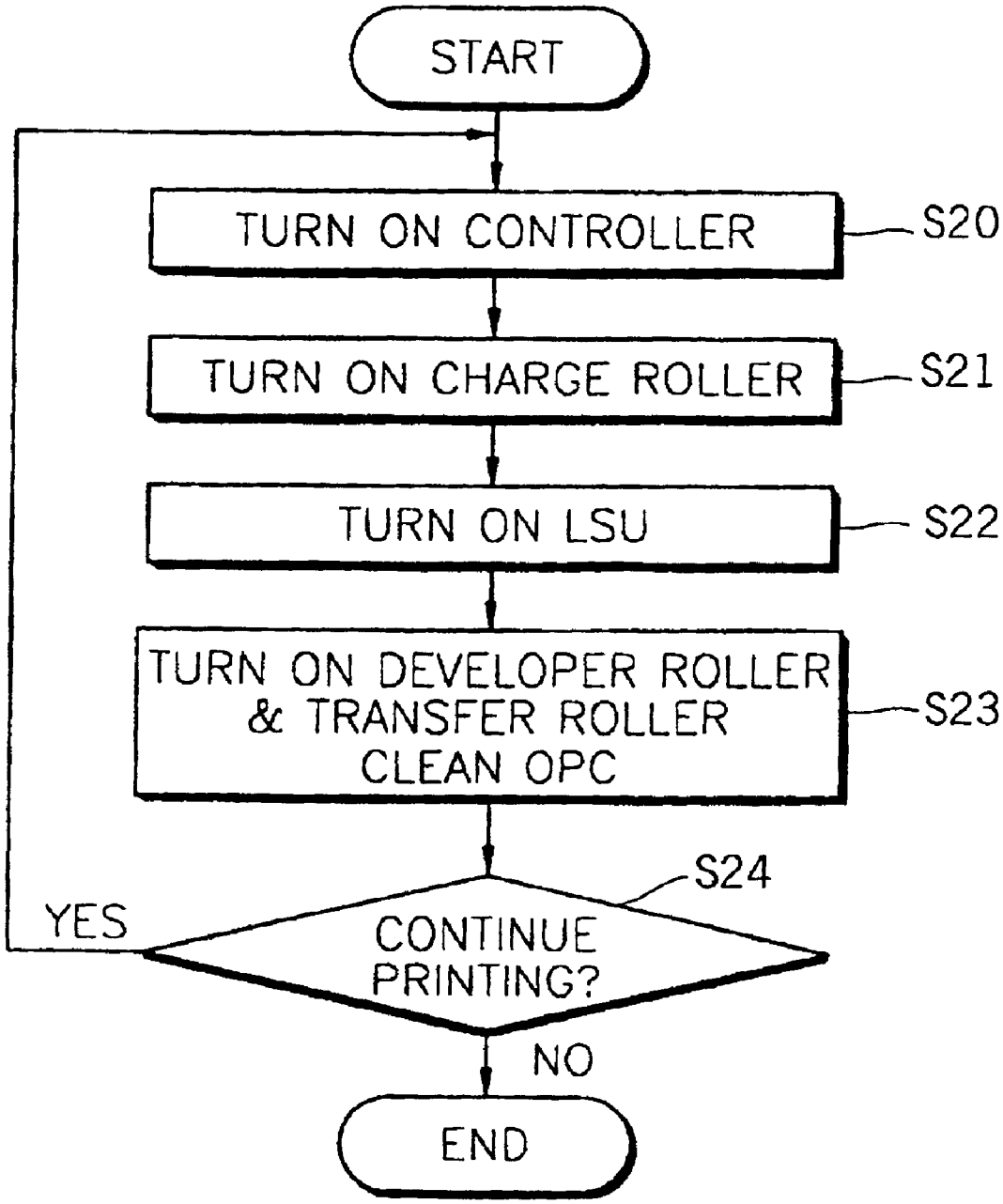
FIG. 2 is a flowchart illustrating a general electrophotographic printing method.

Referring now to FIG. 2, FIG. 2 is a flowchart illustrating a general electrophotographic printing method. When a print command is input from a user, an image which is intended to be printed is input to an electrophotographic imaging apparatus, such as electrophotographic imaging apparatus 1, through a personal computer (PC). The controller 10 starts to operate (ON-state) to form a matrix of dots in accordance with the input image at Step S20. A charge voltage of −1.4 kV is applied to the charge roller 13 under the control of the controller 10 to charge the OPC 14 to a potential of −800 V at Step S21.

Continuing with reference to FIG. 2, the LSU 11 scans the matrix of dots formed on the surface of the OPC 14 with a laser beam in response to a control signal from the controller 10, and the potential of the exposed area of the OPC 14 is changed to have a potential of −50 V and the non-exposed area of the OPC 14 remains at a potential of −800 V at Step S22. When toner particles are applied to the exposed area of the OPC 14 to form a visible image, a sheet of paper P is fed through the nip formed between the transfer roller 16 and the OPC 14. As a high voltage of from 500 to 3,000 V is applied to the transfer roller 16, the toner image formed on the OPC 14 is transferred to the paper P. The toner particles remaining on the OPC 14 which are not transferred to the paper P are removed by the blade 17 and transferred into a recycled toner container 19. As the paper P passes a fusing unit 5, including fusing rollers 5*a*, 5*b*, a permanent image is printed on the paper P by hot pressing at Step S23. If it is determined to continue printing at Step S24, the process returns to Step S20 and the above-described steps are repeated, otherwise the process ends.

Figure 3:
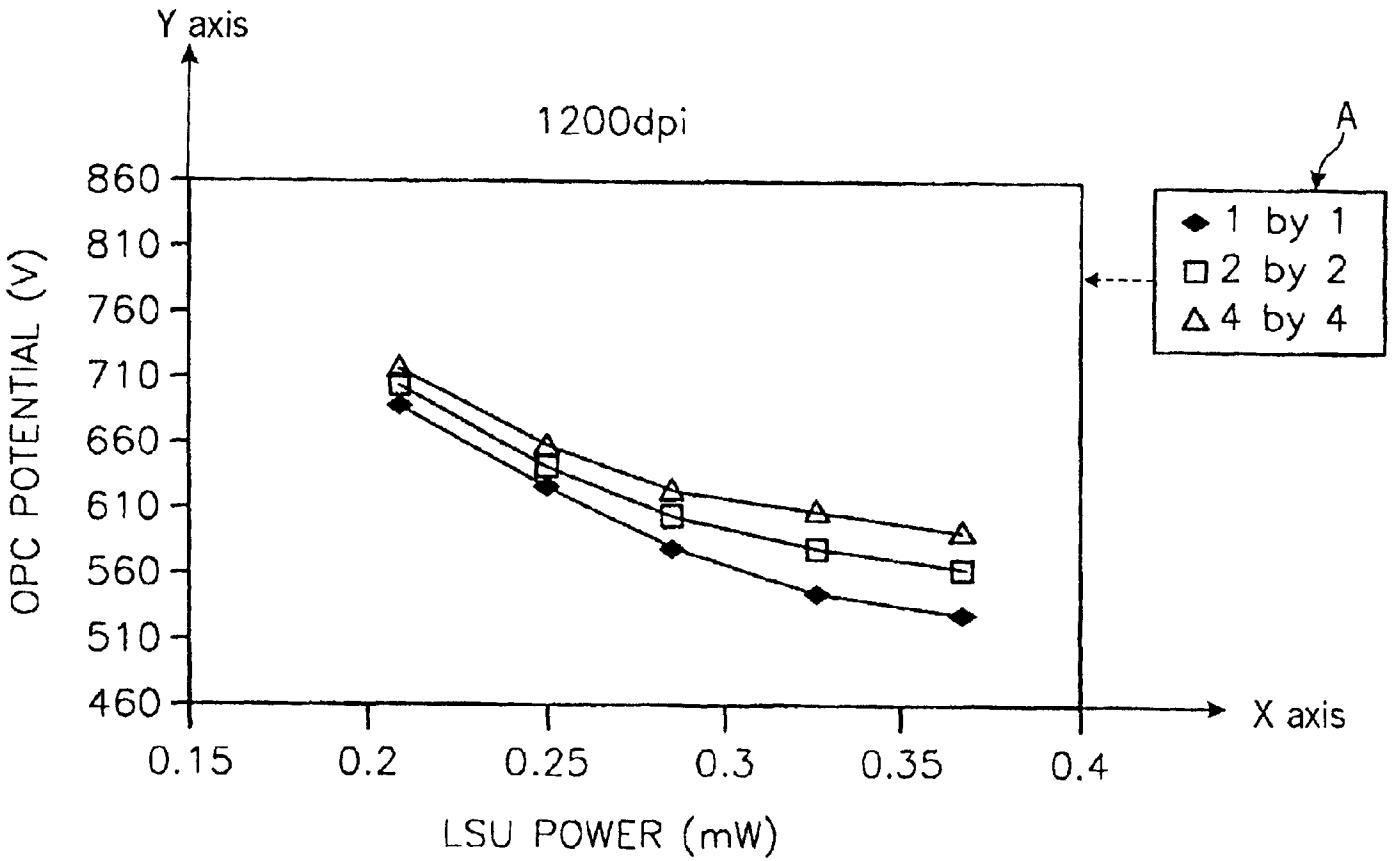
FIG. 3 illustrates the correlation between laser scanning unit (LSU) power, organic photoconductor (OPC) potential, and dot size.

Referring now to FIG. 3, FIG. 3 illustrates the correlation between LSU power in milliwatts (mW), OPC potential in Volts (V), and dot size in dpi. The smaller the dot size, the greater the plot slopes. A greater slope means that the potential variation of the OPC (Y-axis) is increased by variations of the LSU power (X-axis). Here, the potential variation of the OPC is proportional to gray pattern level variation. As can be inferred from FIG. 3, assuming that the same printing conditions are applied, the gray level variation is greater for the 1 by 1 dot size than for the 2 by 2 dot size or than for the 4 by 4 dot size, the dot sizes being indicated by the key box A of FIG. 3. The same result can be obtained from a comparison of the printing results at resolutions of 600 dots per inch (dpi.) and 1200 dpi. In other words, because the dot size is smaller at 1200 dpi. than at 600 dpi., the gray level variation is greater at 1200 dpi. Thus, there can be a problem in that a desired high quality print output typically cannot be obtained.

Figure 4:
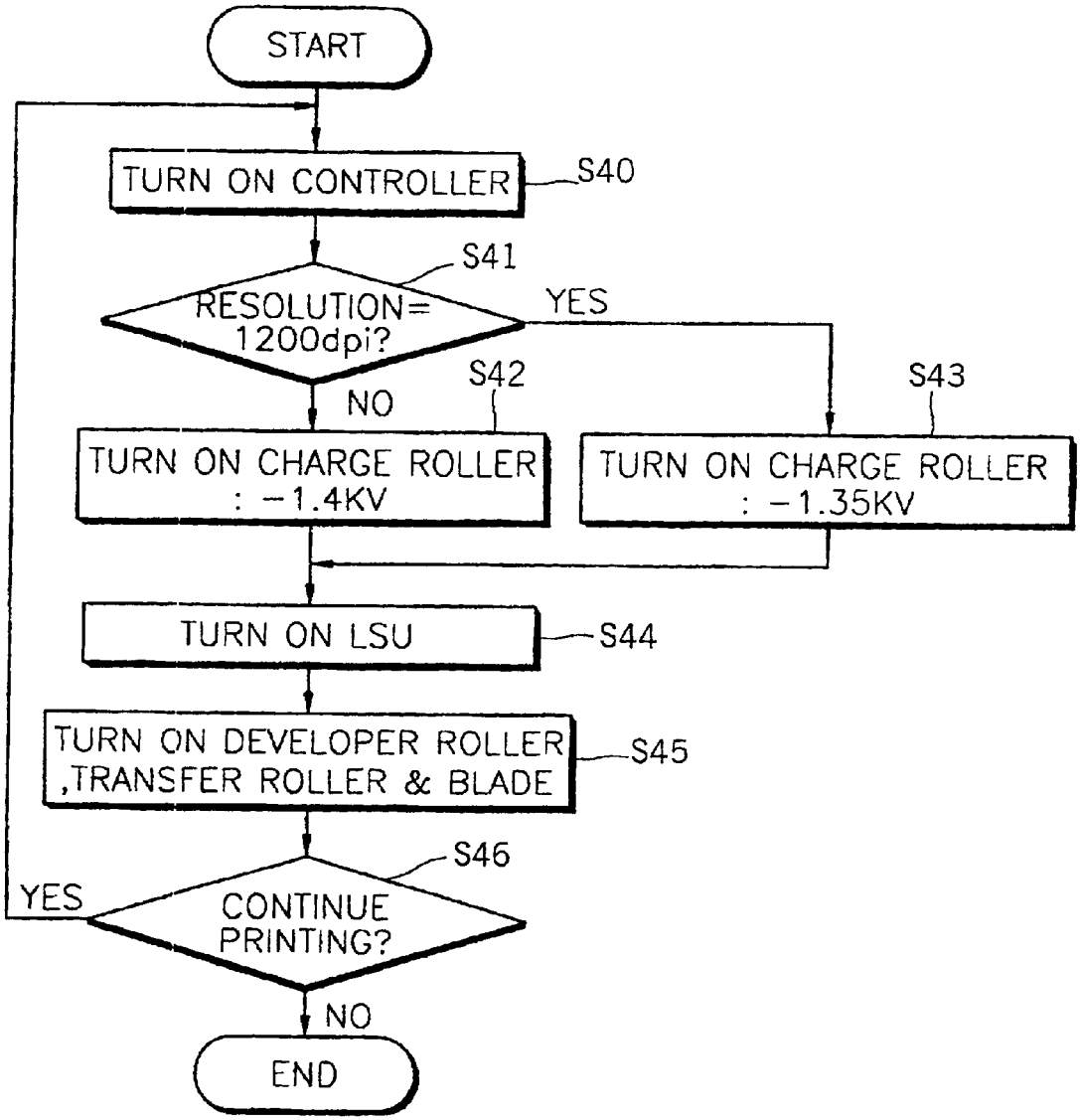
FIG. 4 is a flowchart illustrating a preferred embodiment of an electrophotographic printing method according to the present invention.

Referring now to FIG. 4, a flowchart illustrating a preferred embodiment of an electrophotographic printing method according to the present invention is shown in FIG. 4. Referring to the electrophotographic imaging apparatus 1 of FIG. 1, the electrophotographic printing method illustrated in FIG. 4 involves turning on controller 10 at Step S40; and then determining whether the resolution is 1,200 dots per inch (dpi.) at Step S41; turning on charge roller 13 with application of a voltage of −1.4 kV or −1.35 kV respectively at Steps S42 or S43; turning on a laser scanning unit (LSU) 11 at Step S44; turning on transfer roller 16 and cleaning photoreceptor drum 14 serving as an organic photoconductor (OPC), such as with blade 17, at Step S45; and determining whether to continue printing at Step S46.

In particular, with reference to FIGS. 1 and 4, when a user inputs a print command through a personal computer (PC) to print an image, the controller 10 (see FIG. 1) is turned on to graphic process an electric image to be printed at Step S40. The controller 10 performs an appropriate graphic process depending on the resolution or print mode selected by the user. The user through the personal computer (PC) sets or selects the resolution, such as 600 dots per inch (dpi.), 1200 dpi., or the like, or the print mode, such as text mode or a graphics mode, before the input of the print command. Then in Step S41, it is determined whether the resolution selected by the user is 1200 dpi. at Step S41. If the selected resolution is not 1200 dpi., the process proceeds to Step S42 and the high-voltage power supply (HVPS) 12 applies a charge voltage of a relatively higher level in magnitude of −1.4 kV, for example, to the charge roller 13 under the control of the controller 10 at Step S42. However, if the selected resolution is 1200 dpi., the process proceeds to step S43 and the HVPS 12 applies a charge voltage of a relatively lower level in magnitude of −1.35 kV, for example, to the charge roller 13 under the control of the controller 10 at Step S43. When the resolution is not equal to 1200 dpi., the resolution can be selectively set at a default value, such as 600 dpi. at which the charge voltage of −1.4 kV, for example, is applied at Step S42. The controller 10 in an electrophotographic imaging apparatus or system 1 of the present invention includes appropriate programming, software, and memory so that the charge voltage can be appropriately adjusted depending on the print resolution or print mode according to the present invention, such as described with respect to FIG. 4, so that a high quality image can be obtained with reduced image concentration variation in accordance with the previously described process and apparatus of the present invention.

The lower the resolution, the greater the gray pattern level variation and the poorer the output image quality. In the present invention, the charge voltage is selectively applied to the charge roller 13 to reduce gray pattern level variation. Thus, to enhance the image quality by reducing the gray pattern level variation at a low resolution, the charge voltage of the charge roller 13 is relatively increased in magnitude. Meanwhile, for high resolution image printing, the charge voltage of the charge roller 13 is set to be relatively low in magnitude to reduce the gray pattern level variation. In the present invention, it is assumed that the charge voltage of the charge roller 13 is of a relatively higher level in magnitude of −1.4 kV at a low resolution of 600 dpi. and of a relatively lower level in magnitude of −1.35 kV at a high resolution of 1200 dpi., for example, although the charge voltage of the charge roller 13 can be set to other appropriate charge voltages dependent upon the resolution, such as a selected resolution, a default resolution or the resolution set by the user.

In addition, the charge voltage of the charge roller 13 is varied depending on the print mode. The resolution in a text mode is typically lower than in a graphics mode. Thus, in the low-resolution text mode, the charge voltage of the charge roller 13 is set to by of a relatively higher level in magnitude of −1.4 kV, for example, at Step S42. In the high-resolution graphics mode, the charge voltage of the charge roller 13 is set to be of a relatively lower level in magnitude of −1.35 kV, for example, at step S43.

Thus, the OPC or photoreceptor drum 14 is appropriately charged with a charge voltage which is varied by the controller 10 depending on the resolution or the print mode. When the photoreceptor drum or OPC 14 is charged by the charge roller 13, the process then proceeds to Step S44 and the controller 10 turns on the LSU 11 at Step S44. When the LSU 11 scans a matrix of dots formed on the surface of the OPC or photoreceptor drum 14 with a laser beam in response to a control signal from the controller 10, the potential of the exposed area of the OPC or photoreceptor drum 14 changes to −50V and the potential of the non-exposed area of the OPC or photoreceptor drum 14 remains at −800 V.

Continuing with reference to FIGS. 1 and 4, after the scanning by the LSU 11, the process then proceeds to step S45 and the controller 10 turns on the developer roller 15, the transfer roller 16, and the blade 17 at Step S45. When toner particles adhering to the developer roller 15 are applied to the exposed area of the OPC or photoreceptor drum 14 to form a visible image, a sheet of print medium P, such as a print paper P is fed through a nip formed between the transfer roller 16 and the OPC or photoreceptor drum 14. As a high-voltage of 500 to 3,000 volts (V) is applied to the transfer roller 16, the visible toner image is transferred to the print medium, such as a print paper P. Toner particles remaining on the OPC or photoreceptor drum 14, not transferred to the print paper or print medium P, are removed by the blade 17 and are transferred to waste toner container 19. As the print paper or print medium P passes fusing unit 5, a permanent image is formed on the print paper or print medium P and output by hot pressing of the fusing rollers 5*a*, 5*b* of fusing unit 5. Then, in Step S46, it is determined whether to continue the printing, and, when printing is to continue, the process returns from Step S46 to Step S40 to continue the printing, and the above-described Steps S40 through S45 are the repeated. When printing is not to continue, the process proceeds from Step S46 to End.

Figure 5:
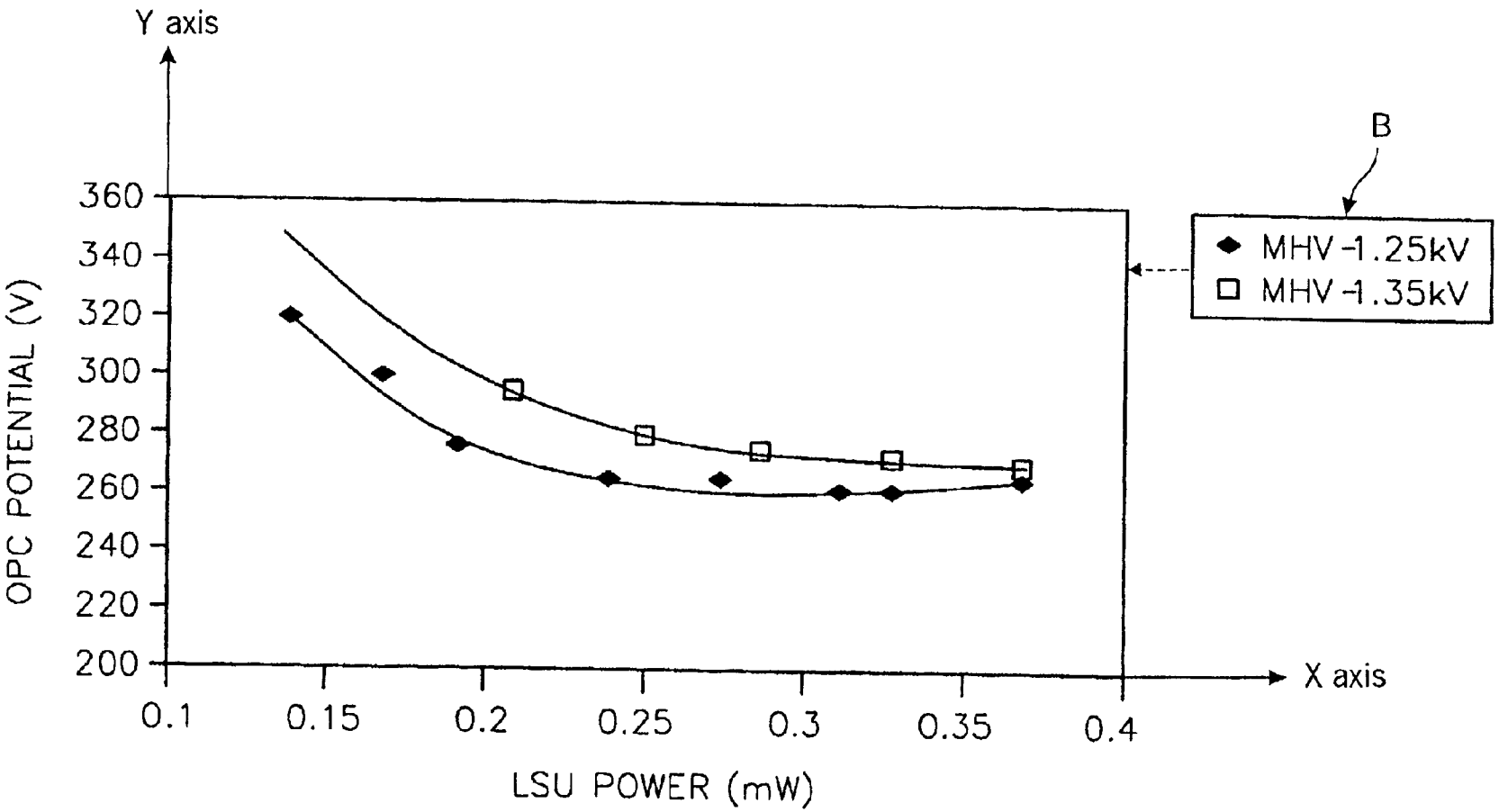
FIG. 5 illustrates the relation between LSU power and OPC potential for a certain dot size with respect to charge voltage variations according to the present invention.

Continuing now with reference to FIG. 5, FIG. 5 illustrates the relation between LSU power in milliwatts (mW) and OPC potential in Volts (V) for a certain dot size with respect to charge voltage variations according to the present invention. In determining an optimal power level of the LSU 11 for the realization of optimal image quality, data on the relation between LSU power (X-axis) and OPC potential (Y-axis), as shown in FIG. 5, is very important. Referring to FIG. 5, and the key box B of FIG. 5 indicating the charge voltage main high voltage (MHV), when the charge voltage is −1.35 kV, for example, the OPC potential becomes flat near an LSU power of 0.33 mW. Thus, the optimal power level of the LSU 11 at a charge voltage of −1.35 kV is determined to be about 0.33 mV taking into account LSU tolerance of the LSU 11. When the charge voltage is changed to −1.25 kV, for example, the OPC potential becomes flat near an LSU power of 0.27 mW. Thus, the optimal power level of the LSU 11 at a charge voltage of −1.25 kV is determined to be about 0.27 mW taking into account LSU tolerance of the LSU 11. As can be inferred from FIG. 5, as the charge voltage becomes relatively low in magnitude, the point at which the OPC potential becomes flat shifts downward. Thus, according to the methods and apparatus of the present invention, for high-resolution printing at 1200 dpi, the point at which the OPC potential becomes flat can be shifted downward by reducing the charge voltage in magnitude, so that the gray pattern formation potential is determined as a low level near the point. As a result, the gray pattern level variation can be reduced with excellent image quality.

As described above, in an electrophotographic imaging apparatus or system and methods of the present invention which allow a user to select the print resolution or print mode, the charge voltage can be appropriately selectively adjusted depending on the print resolution or print mode, so that a high quality image can be obtained with reduced image concentration variation.

While there have been illustrated and described what are considered to be preferred embodiments of the present invention, it will be understood by those skilled in the art that various changes and modifications may be made, and equivalents may be substituted for elements thereof without departing from the true scope of the present invention. In addition, many modifications may be made to adapt a particular situation to the teaching of the present invention without departing from the scope thereof. Therefore, it is intended that the present invention not be limited to the particular embodiments disclosed as the best mode contemplated for carrying out the present invention, but that the present invention includes all embodiments falling within the scope of the appended claims.

What is claimed is:

1. An electrophotographic image printing method for an electrophotographic imaging apparatus, comprising the steps of:

providing an electrophotographic imaging apparatus, the electrophotographic imaging apparatus including: a charge roller; a developer roller; a laser scanning unit; a transfer roller; an organic photoconductor; a power supply unit for supplying power to the charge roller, the developer roller, the laser scanning unit, and the transfer roller; and a controller for controlling the power supply unit, the charge roller, the developer roller, the laser scanning unit, the transfer roller, and the organic photoconductor;

selecting a resolution for electrophotographic printing;

charging the organic photoconductor by selectively applying, to the charge roller, a charge voltage corresponding to the resolution selected for the electrophotographic printing;

setting the charge voltage applied to the charge roller to be relatively higher in magnitude for a lower level of the resolution selected than for a higher level of the resolution selected;

forming an electrostatic latent image on the charged organic photoconductor by means of the laser scanning unit and applying toner particles adhering to the developer roller to the electrostatic latent image to form a visible image; and transferring the visible image formed on the organic photoconductor to a print medium.

2. The method of claim 1, wherein the resolution selected is any one of 600 dpi. and 1200 dpi.

3. The method of claim 1, wherein a charge voltage of −1.35 kV is applied to the charge roller as the charge voltage when the resolution selected is 1200 dpi., and a charge voltage of −1.4 kV is applied to the charge roller as the charge voltage when the selected resolution is 600 dpi.

4. The method of claim 1, wherein the charge voltage is selectively applied to the charge roller to reduce a gray pattern level variation.

5. The method of claim 1, further comprising the step of:

selectively adjusting the charge voltage applied to the charge roller in correspondence to the resolution selected for the electrophotographic printing to reduce image concentration variation.

6. The method of claim 1, wherein, during the charging step, said controller and said power supply unit automatically apply a different magnitude of DC voltage to said charge roller based on said selected resolution immediately prior to and during the formation of said electrostatic image on said organic photoconductor.

7. The method of claim 6, said laser scanning unit automatically applying a different power during said forming step based on said magnitude of said voltage applied to said charge roller.

8. The apparatus of claim 6, said laser scanning unit automatically applying a different power during said forming of said latent image based on said magnitude of said voltage applied to said charge roller.

9. An electrophotographic printing method for an electrophotographic imaging apparatus, comprising the steps of:

providing an electrophotographic imaging apparatus, the electrophotographic imaging apparatus including: a charge roller; a developer roller; a laser scanning unit; a transfer roller; an organic photoconductor; a power supply unit for supplying power to the charge roller, the developer roller, the laser scanning unit, and the transfer roller; and a controller for controlling the power supply unit, the charge roller, the developer roller, the laser scanning unit, the transfer roller, and the organic photoconductor;

selecting a resolution for electrophotographic printing;

charging the organic photoconductor by selectively applying, to the charge roller, a charge voltage corresponding to the resolution selected for the electrophotographic printing;

forming an electrostatic latent image on the charged organic photoconductor by means of the laser scanning unit and applying toner particles adhering to the developer roller to the electrostatic latent image to form a visible image; and transferring the visible image formed on the organic photoconductor to a print medium;

wherein a gray pattern level variation at a low resolution is reduced by applying a charge voltage to the charge roller that is relatively large in magnitude relative to a charge voltage applied to the charge roller to reduce the gray pattern level variation at a high resolution.

10. An electrophotographic printing method for an electrophotographic imaging apparatus, comprising the steps of:

providing an electrophotographic imaging apparatus, the electrophotographic imaging apparatus including: a charge roller; a developer roller; a laser scanning unit; a transfer roller; an organic photoconductor; a power supply unit for supplying power to the charge roller, the developer roller, the laser scanning unit, and the transfer roller; and a controller for controlling the power supply unit, the charge roller, the developer roller, the laser scanning unit, the transfer roller, and the organic photoconductor;

selecting a print mode for electrophotographic printing;

charging the organic photoconductor by selectively applying, to the charge roller, a charge voltage having a magnitude which is dependent upon the print mode selected for the electrophotographic printing;

forming an electrostatic latent image on the charged organic photoconductor by means of the laser scanning unit and applying toner particles adhering to the developer roller to the electrostatic latent image to form a visible image; and transferring the visible image formed on the organic photoconductor to a print medium;

wherein a charge voltage of −1.4 kV is applied to the charge roller as the charge voltage when the print mode selected is a text mode, and a charge voltage of −1.35 kV is applied to the charge roller as the charge voltage when the print mode selected is a graphics mode.

11. The electrophotographic printing method of claim 10, the voltage magnitude applied to the charge roller having a relatively higher magnitude when a text mode is selected as the print mode than when a graphics mode is selected as the print mode.

12. The method of claim 10, the print mode selected corresponding to one of a text mode and a graphics mode.

13. The method of claim 12, the text mode being of a relatively lower resolution than a resolution for the graphics mode.

14. The method of claim 10, wherein it is a DC magnitude of voltage and not an AC magnitude of voltage applied to the charge roller that is varied and dependent upon the selected print mode.

15. The method of claim 10, further comprising the step of:

selectively adjusting the charge voltage applied to the charge roller in correspondence to the print mode selected for the electrophotographic printing to reduce image concentration variation.

16. The method of claim 10, wherein, during the charging step, said controller and said power supply unit automatically apply a different magnitude of voltage to said charge roller based on said selected print mode immediately prior to and during the formation of said electrostatic image on said organic photoconductor.

17. The method of claim 16, said laser scanning unit automatically applying a different power during said forming step based on said magnitude of said voltage applied to said charge roller.

18. An electrophotographic printing method for an electrophotographic imaging apparatus, comprising the steps of:

providing an electrophotographic imaging apparatus, the electrophotographic imaging apparatus including: a charge roller; a developer roller; a laser scanning unit; a transfer roller; an organic photoconductor; a power supply unit for supplying power to the charge roller, the developer roller, the laser scanning unit, and the transfer roller; and a controller for controlling the power supply unit, the charge roller, the developer roller, the laser scanning unit, the transfer roller, and the organic photoconductor;

selecting a print mode for electrophotographic printing;

charging the organic photoconductor by selectively applying, to the charge roller, a charge voltage having a magnitude which is dependent upon the print mode selected for the electrophotographic printing;

forming an electrostatic latent image on the charged organic photoconductor by means of the laser scanning unit and applying toner particles adhering to the developer roller to the electrostatic latent image to form a visible image; and transferring the visible image formed on the organic photoconductor to a print medium;

wherein a gray pattern level variation at a low resolution is reduced by applying a charge voltage to the charge roller that is relatively large in magnitude relative to a charge voltage applied to the charge roller to reduce the gray pattern level variation at a high resolution.

19. An electrophotographic imaging apparatus for electrophotographic printing, comprising:

a charge roller;

a developer roller;

a laser scanning unit;

a transfer roller;

an organic photoconductor;

a power supply unit for supplying power to the charge roller, the developer roller, the laser scanning unit, and the transfer roller;

a controller for controlling the power supply unit, the charge roller, the developer roller, the laser scanning unit, the transfer roller, and the organic photoconductor;

means for selecting a resolution for electrophotographic printing;

means for selectively applying, to the charge roller, a charge voltage so as to charge the organic photoconductor, the charge voltage corresponding to the resolution selected for the electrophotographic printing;

means for forming an electrostatic latent image on the charged organic photoconductor, and for applying toner particles adhering to the developer roller to the electrostatic latent image to form a visible image; and means for transferring the visible image formed on the organic photoconductor to a print medium;

wherein the charge voltage selectively applied to the charge roller is relatively large in magnitude for a lower level of the selected resolution and is relatively small in magnitude for a higher level of the selected resolution.

20. The electrophotographic imaging apparatus of claim 19, wherein a charge voltage of −1.35 kV is applied to the charge roller as the charge voltage when the resolution selected is 1200 dpi., and a charge voltage of −1.4 kV is applied to the charge roller as the charge voltage when the resolution selected is 600 dpi.

21. The electrophotographic printing apparatus of claim 19, wherein one of −1.4 kV and −1.35 kV is selectively applied to the charge roller as the charge voltage.

22. The apparatus of claim 19, wherein said controller and power supply unit automatically apply a voltage of a different magnitude to said charge roller based on said selected resolution immediately prior to and during the formation of said electrostatic image on said organic photoconductor.

23. The apparatus of claim 22, said laser scanning unit automatically applying a different power during said forming of said latent image based on said magnitude of said voltage applied to said charge roller.

24. An electrophotographic imaging apparatus for electrophotographic printing, comprising:

a charge roller;

a developer roller;

a laser scanning unit;

a transfer roller;

an organic photoconductor, said organic photoconductor being charged by said charge roller;

an input unit for input of a print job, and for input of a print mode for said print job;

a power supply unit supplying power to the charge roller, the developer roller, the laser scanning unit, and the transfer roller; and a controller connected to said input unit and said power supply unit, said controller being programmed and configured to control the power supply unit, the charge roller, the developer roller, the laser scanning unit, the transfer roller, and the organic photoconductor, said controller being programmed and configured to cause said power supply unit to apply one of a first voltage having a first magnitude and a second voltage having a second, different magnitude to said charge roller based on a selected print mode for said print job, said laser scanning unit illuminating said organic photoconductor to form an electrostatic latent image on the charged organic photoconductor, said developer roller applying toner particles to the electrostatic latent image on the organic photoconductor to form a visible image on the organic photoconductor, said transfer roller transferring the visible image formed on the organic photoconductor to a print medium;

wherein the power supply unit selectively charges the charge roller with a charge voltage that is relatively high in magnitude when said selected print mode is text mode and relatively low in magnitude when said selected print mode is graphics mode.

25. The electrophotographic imaging apparatus of claim 24, wherein the power supply unit applies, to the charge roller, a charge voltage of −1.35 kV DC as the first voltage magnitude when the print mode selected is the graphics mode, and the power supply unit applies, to the charge roller, a charge voltage of −1.4 kV DC as the second voltage magnitude when the print mode selected is the text mode.

26. The electrophotographic printing apparatus of claim 24, said controller being programmed and configured to cause said laser scanning unit to illuminate said organic photoconductor to form said latent image on said organic photoconductor at one of a first power and a second and different power based on the print mode selected.

27. A method for forming an image in an electrophotographic apparatus, said method comprising the steps of:

submitting a print job from a user via software, said print job comprising a type of print job selected by said user;

automatically charging a charge roller to a magnitude of voltage based on the type of print job selected by the user prior to printing;

charging an organic photoconductor drum via said charge roller;

forming a latent image on said photoconductor drum by illuminating said photoconductor drum via a light source, a power of said light source forming the latent image being based on the magnitude of voltage to which said charge roller is charged; and creating a visible image from said latent image via a developer roller positioned adjacent to said photoconductor drum, said developer roller supplying toner particles to said photoconductor drum to convert said latent image on said photoconductor drum into said visible image; and transferring the visible image to a print medium;

wherein, when the type of print job is a resolution of the print job, the magnitude of voltage to which said charge roller is charged is greater for a lower resolution and smaller for a higher resolution.

28. The method of claim 27, wherein said controller causes said light source to operate at an appropriate power level based on the magnitude of voltage applied to said charge roller.

29. An electrophotographic imaging apparatus for electrophotographic printing, comprising:

a charge roller;

a developer roller;

a laser scanning unit;

a transfer roller;

a photoconductive drum, said photoconductive drum being charged by said charge roller, said laser scanning unit illuminating said photoconductive drum to form a latent image on said photoconductive drum, and said charge roller, said developer roller, said transfer roller and said laser scanning unit being disposed in operational relationship to said photoconductive drum;

an input unit for inputting a print job and selecting a print mode for said print job;

a power supply unit for supplying power to the charge roller, the developer roller, the laser scanning unit, and the transfer roller; and a controller connected between said input unit and said power supply, said controller being programmed and configured to control the power supply unit and cause said power supply to apply one of a first DC voltage magnitude and a second and different DC voltage magnitude to said charge roller based on said selected print mode for said print job, said laser scanning unit illuminating said photoconductive drum to form an electrostatic latent image on the charged photoconductive drum, said developer roller applying toner particles to the electrostatic latent image on the photoconductive drum to form a visible image on the photoconductive drum, said transfer roller transferring the visible image formed on the photoconductive drum to a print medium;

wherein the power supply unit selectively charges the charge roller with a charge voltage that is relatively high in DC magnitude when said selected print mode is text mode, and with a charge voltage which is relatively low when said print mode is graphics mode.

30. The electrophotographic imaging apparatus of claim 29, wherein the power supply unit applies, to the charge roller, a charge voltage of −1.35 kV DC when the selected print mode is the graphics mode, and the power supply unit applies, to the charge roller, a charge voltage of −1.4 kV DC when the selected print mode is the text mode.

31. A method for forming an image in an electrophotographic apparatus, said method comprising the steps of:

submitting a print job from a user via software, said print job comprising a type of print job selected by said user;

automatically charging a charge roller to a magnitude of voltage based on the type of print job selected by the user prior to printing;

charging an organic photoconductor drum via said charge roller;

forming a latent image on said photoconductor drum by illuminating said photoconductor drum via a light source, a power of said light source forming the latent image being based on the magnitude of voltage to which said charge roller is charged; and creating a visible image from said latent image via a developer roller positioned adjacent to said photoconductor drum, said developer roller supplying toner particles to said photoconductor drum to convert said latent image on said photoconductor drum into said visible image; and transferring the visible image to a print medium;

wherein, when the type of print job is a selection between a text mode and a graphics mode, the magnitude of voltage to which said charge roller is charged is greater for the text mode and smaller for the graphics mode.

* * * * *